US009856066B2

(12) United States Patent
Breaz

(10) Patent No.: US 9,856,066 B2
(45) Date of Patent: Jan. 2, 2018

(54) MODULAR ELEMENT FOR STORAGE BASIN CONSTRUCTION, SUPPORTING STRUCTURE, METHOD OF CONSTRUCTION THEREOF

(71) Applicant: Laurentiu Dumitru Breaz, Alba (RO)

(72) Inventor: Laurentiu Dumitru Breaz, Alba (RO)

( * ) Notice: Subject to any disclaimer, the term of this patent is extended or adjusted under 35 U.S.C. 154(b) by 110 days.

(21) Appl. No.: 14/418,233

(22) PCT Filed: Jul. 24, 2013

(86) PCT No.: PCT/RO2013/000013
§ 371 (c)(1),
(2) Date: Jan. 29, 2015

(87) PCT Pub. No.: WO2014/084748
PCT Pub. Date: Jun. 5, 2014

(65) Prior Publication Data

US 2015/0259125 A1 Sep. 17, 2015

(30) Foreign Application Priority Data

Jul. 30, 2012 (RO) ..... a201200568

(51) Int. Cl.
*B65D 81/38* (2006.01)
*E04B 2/18* (2006.01)
(Continued)

(52) U.S. Cl.
CPC ..... *B65D 81/3825* (2013.01); *B65D 81/18* (2013.01); *B65D 90/024* (2013.01);
(Continued)

(58) Field of Classification Search
CPC .... B65D 90/024; B65D 90/028; B65D 81/18; E04B 2/26; E04B 2/32; E04B 2/36; E04B 2/22; E04B 2/18
(Continued)

(56) References Cited

U.S. PATENT DOCUMENTS 3,374,917 A * 3/1968 Troy ..... A63H 33/08 206/504
3,693,307 A * 9/1972 Muse ..... E04B 2/18 52/438
(Continued)

FOREIGN PATENT DOCUMENTS

DE 2156006 A1 7/1973
DE 7808241 U1 7/1978
(Continued)

*Primary Examiner* — Robert Poon
(74) *Attorney, Agent, or Firm* — Lucas & Mercanti, LLP

(57) ABSTRACT

The invention relates to modular elements for building a storage basin, to a network obtained by assembling a plurality of modular elements, to a supporting structure, to a storage basin and to a process for obtaining a storage basin. The modular element according to the invention is provided in the interior with a network element constituted by main half joints (10), secondary half joints (11) and tertiary half joints (10), vertical channels (8,15), oblique channels (9), compartments (18), and is provided with joint elements (16,17). The network comprises horizontal annular channels and main, secondary and tertiary joints connected by vertical and oblique channels. The storage basin comprises a supporting structure at the interior of an insulating structure obtained by assembling the modular elements. The process for obtaining a storage basin comprises the assemblage of the modular elements and casting the hardening material in the network obtained by assembling the modular elements, forming the supporting structure.

10 Claims, 7 Drawing Sheets

(51) Int. Cl.

| | |
|---|---|
| ***E04B 2/22*** | (2006.01) |
| ***E04B 2/26*** | (2006.01) |
| ***E04B 2/32*** | (2006.01) |
| ***E04B 2/36*** | (2006.01) |
| ***E04H 7/18*** | (2006.01) |
| ***B65D 90/02*** | (2006.01) |
| ***B65D 81/18*** | (2006.01) |
| *E04B 2/02* | (2006.01) |

(52) U.S. Cl.
CPC ..... *B65D 90/028* (2013.01); *E04B 2/18* (2013.01); *E04B 2/22* (2013.01); *E04B 2/26* (2013.01); *E04B 2/32* (2013.01); *E04B 2/36* (2013.01); *E04H 7/18* (2013.01); *E04B 2002/0221* (2013.01); *E04B 2002/0265* (2013.01); *Y10T 29/4998* (2015.01)

(58) Field of Classification Search
USPC ..... 220/592.22, 592.2, 592.28, 567.3
See application file for complete search history.

(56) References Cited

U.S. PATENT DOCUMENTS

| | | | | |
|---|---|---|---|---|
| 6,691,485 | B1 * | 2/2004 | Prokofyev | E04B 2/14 52/405.1 |
| 2002/0017070 | A1 | 2/2002 | Batch | |
| 2002/0148187 | A1 * | 10/2002 | Walters | E04B 2/14 52/604 |
| 2003/0029118 | A1 * | 2/2003 | Grau | E04B 2/22 52/596 |
| 2004/0000114 | A1 * | 1/2004 | Schools | E04B 2/18 52/505 |
| 2005/0011899 | A1 * | 1/2005 | Saitoh | B65D 88/08 220/565 |
| 2005/0257466 | A1 * | 11/2005 | Tabeshnekoo | E04B 2/16 52/314 |
| 2006/0059838 | A1 * | 3/2006 | Pimental | E04B 2/26 52/596 |
| 2008/0250736 | A1 * | 10/2008 | Breaz | E04C 1/41 52/220.2 |
| 2015/0075106 | A1 * | 3/2015 | Vandenbempt | E04B 2/18 52/596 |

FOREIGN PATENT DOCUMENTS

| | | | |
|---|---|---|---|
| FR | 2343104 | A1 | 9/1977 |
| FR | 2533956 | A1 | 4/1984 |
| GB | 1170103 | A | 11/1969 |
| RO | 1233373 | B1 | 11/2011 |
| WO | WO 2007/081233 | A2 | 7/2007 |
| WO | WO 2009/061227 | A2 | 5/2009 |
| WO | WO 2012/008864 | A1 | 1/2012 |

* cited by examiner

MODULAR ELEMENT FOR STORAGE BASIN CONSTRUCTION, SUPPORTING STRUCTURE, METHOD OF CONSTRUCTION THEREOF

CROSS REFERENCE TO RELATED APPLICATIONS

This application is the US National Phase of PCT/RO2013/000013 filed 24 Jul. 2013, published 5 Jun. 2014 as WO 2014/084748 A2, and claiming the priority of Romanian Patent Application a201200568 filed 30 Jul. 2012, whose entire disclosures are herewith incorporated by reference.

TECHNICAL FIELD

The invention relates to modular elements made of insulating material for building storage basins, made of insulating materials, comprising at the interior at least one network element, to a network obtained by assemblying the modular elements, to a supporting structure and to a process for building a storage basin by assemblying the modular elements.

BACKGROUND ART

The patent US2002017070 describes an expanded plastic module destined for building an insulated concrete wall structure, by assembling the modules and filling them with concrete. For example, the module is made of expanded polystyrene. Each module has the form of a rigid block, having an interior configuration designed to be filled with concrete. Additionally, for increasing the strength, a network of steel or plastic bars is being introduced inside the modules. The disadvantage of this technical solution consists in a high rate of concrete consumption, flow problems when casting the concrete, due to the form of the internal channels, positioned perpendicularly along the vertical and horizontal axes; also, a too complex construction and additional manual working, brought about by the network of bars. Modular elements for constructions are known from RO123373. The disadvantage of this solution is the difficulty of fabrication said modular elements.

The patent GB1170103 describes a element for construction made of an insulating material, for arched structures like domes, having a network of inner vertical and oblique channels. The disadvantage of this technical solution is casting the concrete each time after one row of the dome like construction is built, implying high costs and supplementary time for the labour. Moreover, it does not permit the distribution of concrete between the successive layers of construction elements.

The problem solved by this invention is the achievement of a highly energy effective storage basin with a supporting structure adequate for the pressure exerted by the stored material.

The purpose of this invention is the achievement of a storage basin without concrete forming elements, by a simple and economic process.

The technical solution consists in the use of modular elements for building a thermically insulating structure, having at the interior a network of channels in which a hardening material constituting the supporting structure is cast.

DISCLOSURE OF THE INVENTION

The modular element according to the invention removes the previously mentioned disadvantages, as it comprises a body having a superior face, an inferior face, an interior face, an exterior face and lateral faces extending vertically between the superior and inferior face, said body comprising at the inside at least two oblique channels and at least a vertical channel, the vertical channel being provided between the oblique channels, the vertical channel uniting the superior face with the inferior face of the body, said channels communicating between them forming at least a main half joint, the oblique channels opening to the superior face or the inferior face and to the lateral faces and extending from the median zone at least of the superior face of the body to the median zones of the lateral faces of the body, forming the secondary half joints, the vertical channels opening to the superior and inferior faces forming the main half joints and tertiary half joints, the modular element having joint elements for the connection to other modular elements.

The modular element according to the invention removes previous disadvantages as it comprises a U profile having a horizontal bottom face with at least one vertical channel, an interior and an exterior wall representing coaxial cylinder sectors and a lid having an upper horizontal face with at least one vertical channel and assemblage elements with the U profile, the modular element being also provided with joint elements for the connection to other modular elements.

The network obtained by assembling the modular elements removes the previously mentioned disadvantages, as it is made up of horizontal annular channels, and main, secondary and tertiary joints, connected by vertical and oblique channels.

The unitary supporting structure according to the invention removes the above mentioned disadvantages, as it is obtained by casting a material that hardens in the network according to the invention.

The storage basin according to the invention removes the previously mentioned disadvantages as it is made up of a unitary supporting structure inside an insulating structure, obtained by assembling the modular elements.

The process for building the storage basin according to the invention removes the disadvantages mentioned above as it comprises successive steps of assembling the modular elements in both horizontal and vertical planes for the formation of 1-5 rows, followed by casting a hardening material in the network thus created, and placing on top of a metallic structure on which insulating plates are layd, constituting a thermically insulating lid of the basin.

The modular elements according to the invention are made of synthetic foams based on polyurethanes, polyimides, polyethylene, polypropylene, polyvinyl chloride, polyvinylidene chloride, amino resins, phenolic resins, silicones, expanded polystyrene, sodium silicate.

The material to be cast in the network according to the invention, in order to harden and to form the supporting structure of the storage basin may be one of the following: concrete, reinforced concrete, polyesther resins, epoxy resins, polyurethane resins.

Storage basins are thus obtained, having a very good heat transfer coefficient ($U=0.08\ W/m^2K$) and resisting to a pressure of an water column of 10 m high. The storage basin can take any shape, preferably cylindrical, as the discharges are unitary, requiring a less supporting structure. For high or inequable pressures, higher density foams are used, increasing the costs.

The storage basin can be used for storage of a thermic agent heated during the warm season by solar panels or any other convenient heat source, the thermic agent being used during the cold season for heating the house water or the living space. The heat transfer from the thermic agent to the house heating system or to the house water is made by any adequate means, preferably by coils. The thermic agent used may be water, sand or any other material adequate for such use. If the thermic agent is water, unmineralized water is preferred.

The storage basin may be also used for the storage of a cooling agent during the cold season, ice for example, using it for cooling, in order to obtain conditioned air for cooling a living space during the warm season.

The main joint is defined as the geometrical position determined by the intersection of vertical and oblique channels.

The secondary joint is defined as the geometrical position determined by the intersection of oblique channels.

The tertiary joint is defined as the geometrical position determined by the intersection of vertical channels.

The main half-joint is defined as a part of a main joint.

The secondary half-joint is defined as a part of a secondary joint.

The tertiary half-joint is defined as a part of a tertiary joint.

A network element is a part of the network achieved by assembling the modular elements.

The following advantages are obtained by using this invention:

1. the achievement of a storage basin with appropriate strength structure and very good heat insulation, without any elements of concrete forming, using a simple and cost effective process;
2. shorter time for building the construction, compared to traditional processes;
3. reduced consumption of hardening material for obtaining the supporting structure.

BRIEF DESCRIPTION OF DRAWINGS

Hereinafter, the invention is described in detail, with references to FIGS. 1-7 which represent.

Figure 1:
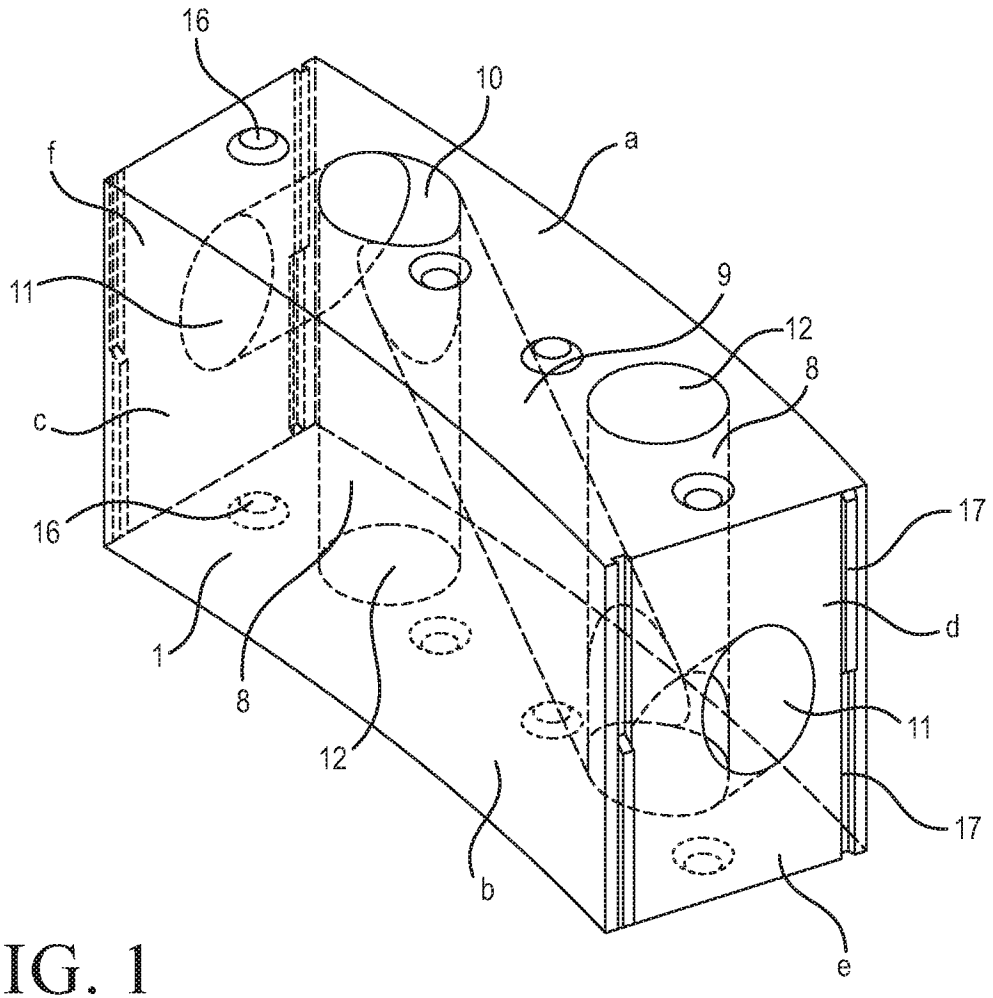
FIG. 1. Modular element for the wall
Figure 2:
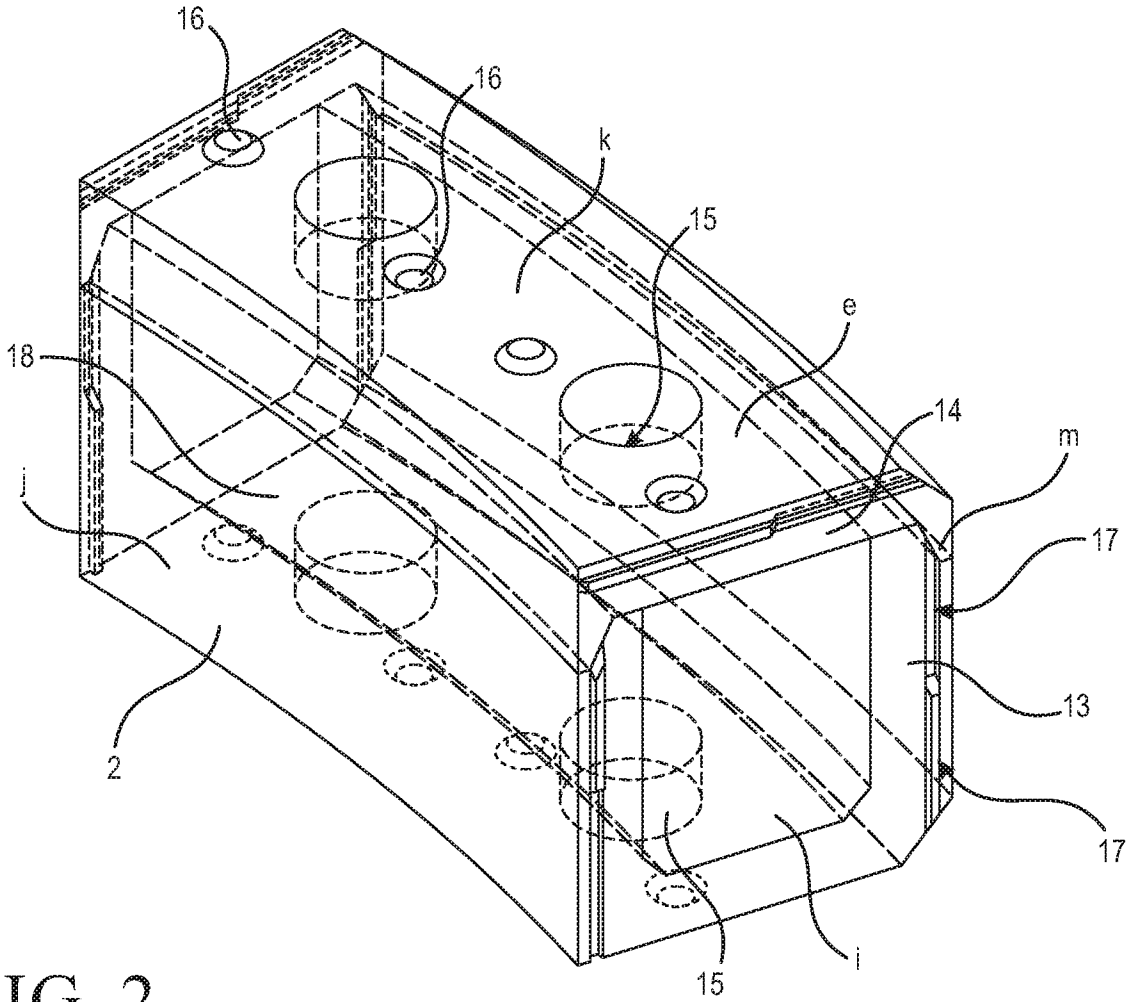
FIG. 2. Modular element for strengthening.
Figure 3:
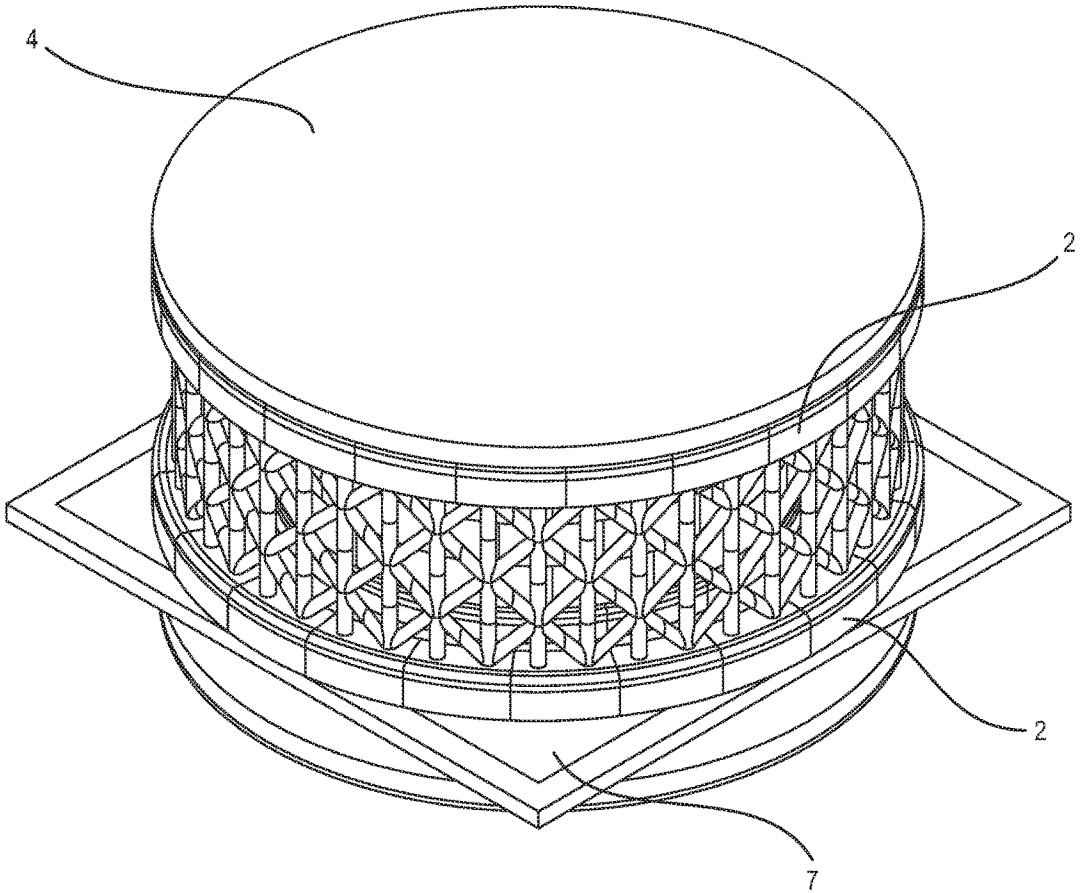
FIG. 3. Perspective view of the storage basin covered with the lid.
Figure 4:
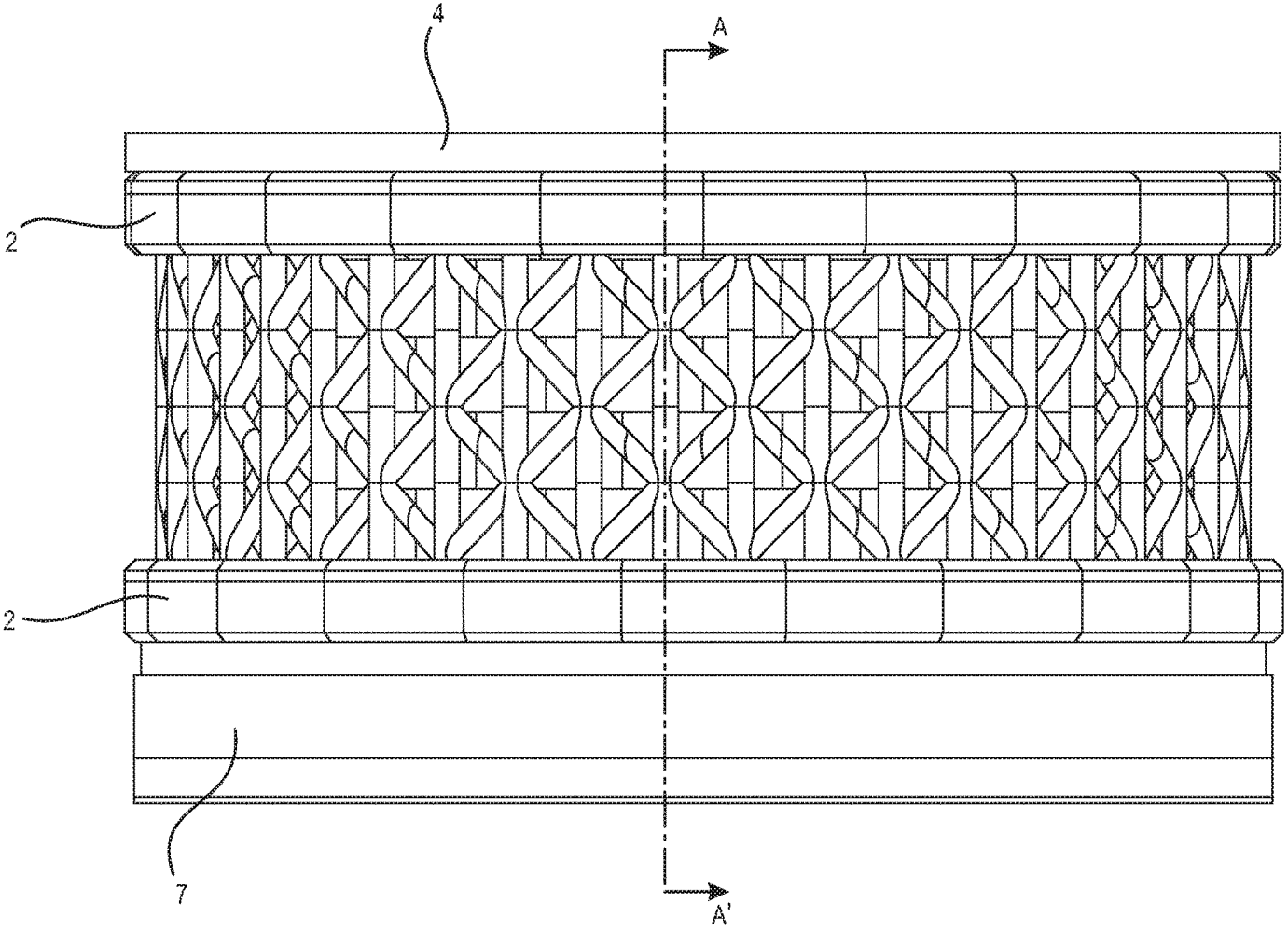
FIG. 4. Lateral view of the storage basin.
Figure 5:
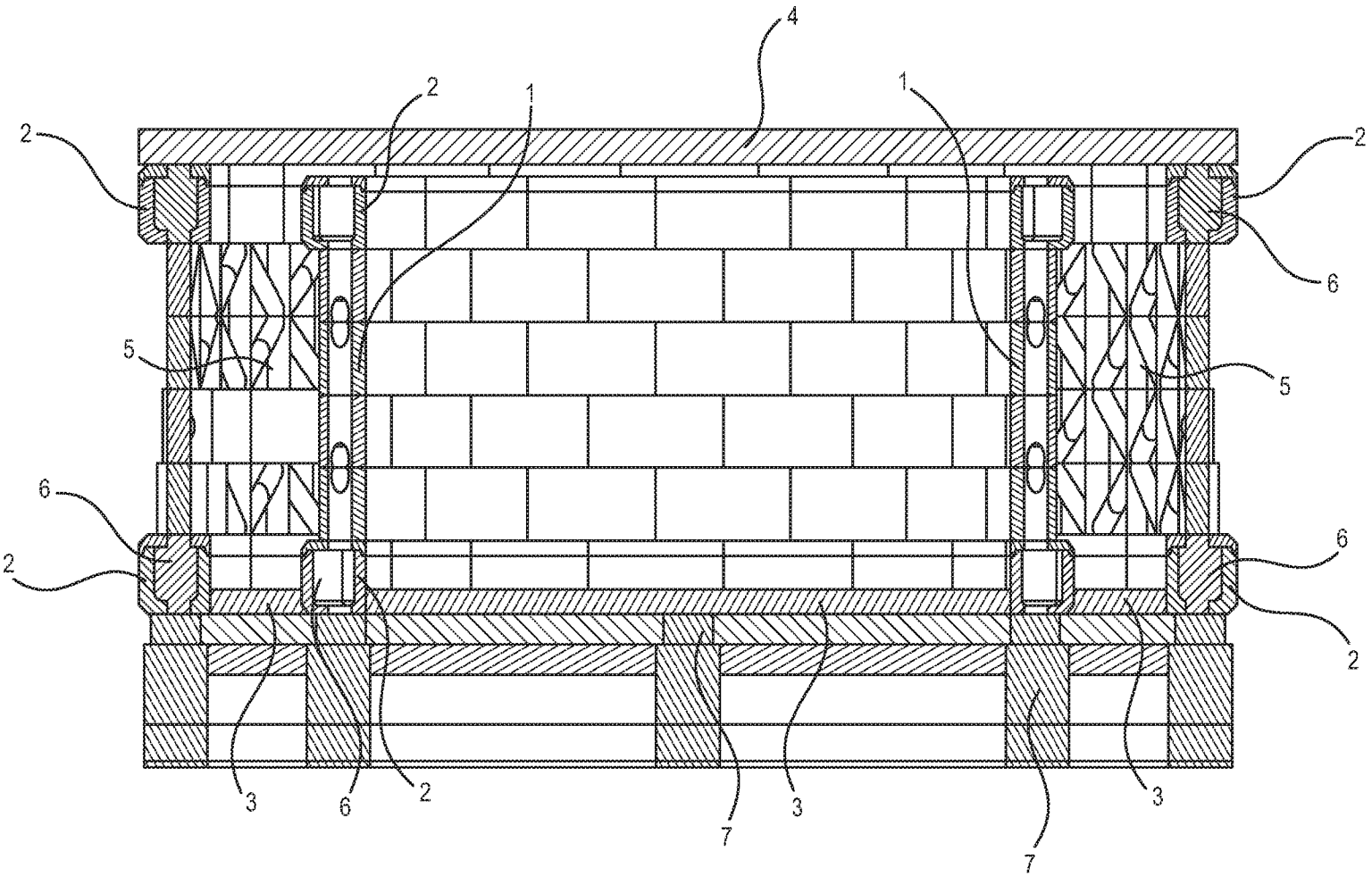
FIG. 5. Section view on AA' plan of the storage basin represented in FIG. 4.
Figure 6:
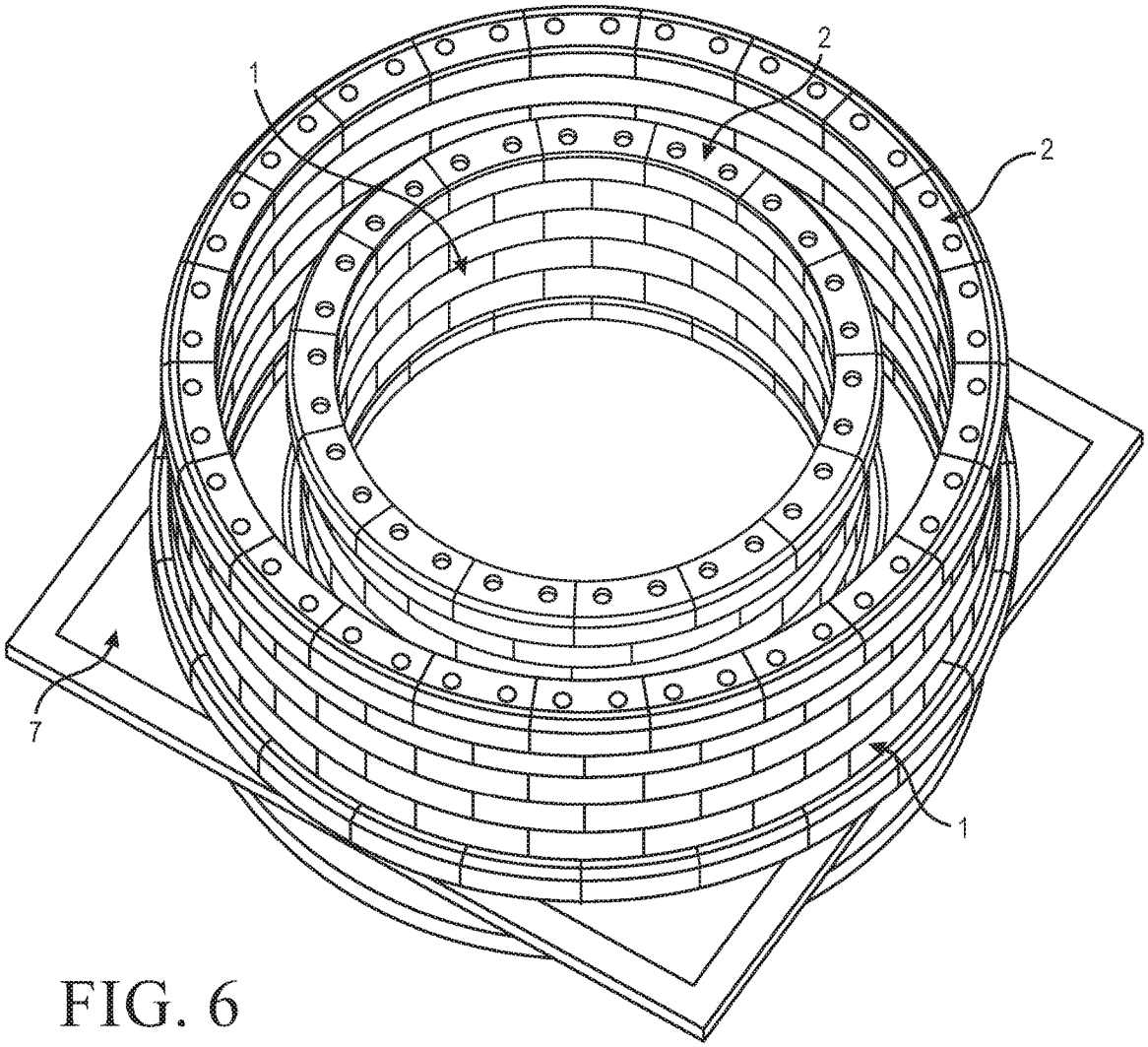
FIG. 6. Perspective view of the "tank in tank" storage basin.

The modular element 1 comprises a body having a superior face a, an inferior face b parallel to face a, an interior face c and an exterior face d representing coaxial cylinder sectors and lateral faces e, f extending vertically between the superior face a and the inferior face b, belonging to planes that intersect in the cylinders axis. The modular element 1 comprises at the interior three oblique channels 9, two vertical channels 8 being provided between the oblique channels 9, the vertical channels 8 uniting the superior face a with the inferior face b of the modular element body 1. The vertical channels 8 communicate with the oblique channels 9, forming two main half joints 10. The oblique channels 9 open to the superior face a and/or the inferior face b, extending between the main half joints 10, respectively from the median zone of at least the superior face a towards the median zones of the lateral faces e, f of the modular element body 1, forming secondary half joints 11. The vertical channels 8 open to the superior face a and the inferior face b, extending from the main half joints 10 to the median zones of the opposed superior face a or inferior face b, forming the tertiary half joints 12. The lateral faces e, f are provided with joint elements 16, with "tooth" like shape, being used for jointing laterally with adjacent modular elements from the same row. The superior face a and the inferior face b are provided with joint elements 17 with truncated cone like shape, being used for jointing with adjacent superposed modular elements. The vertical channels 8 and the oblique channels 9 can take any form in cross section, for example circular, oval, squared, pentagonal, hexagonal etc., the circular channels being preferred. Cylindrical vertical channels 8 with circular cross section have a diameter of 15-30 cm, preferably 20 cm. The distance between the axes of the vertical channels 8 is preferably 60 cm. The oblique channels 9 have a diameter of 12-28 cm, preferably 18 cm. The distance between the lateral face e, f and the axis of the nearest vertical channel 8 is preferably 30 cm. The angle between the axis of the vertical channel 8 and the axis of the oblique channel 9 can vary between 40-50°, preferably the angle being 45°, because at this value, an optimal discharge of forces on the basin wall was remarked. The modular element 1 can have any adequate dimension for a storage basin construction, preferably 60 cm height, 40 cm thick and 120 cm or a multiple of 120 cm long, but not limited thereof.

The modular element 2 comprises a U profile 13 having a horizontal bottom face i, provided with two vertical channels 15, a wall j situated towards the interior and a wall k towards the exterior, representing coaxial cylinder sectors, and a lid 14 having a horizontal upper face l provided with two vertical channels 15 and assemblage elements m with the U profile 13. The upper part of the walls j, k is designated such that it could be matched with the assemblage elements m of the lid 14. The walls j, k and the faces i, l of the U profile 13 and of the lid 14 delimit a compartment 18 inside the modular element 2. The walls j, k are provided with joint elements 16 having "tooth" like shape, being used for jointing laterally with adjacent modular elements from the same row. The upper face l and the bottom face i are provided with joint elements 17 with truncated cone like shape, being used for jointing with adjacent superposed modular elements. The modular element 2 can have any adequate dimensions for the construction of a storage basin, preferably 120 cm or a multiple of 120 cm long, 55 cm thick and 65 cm height, the thickness of the walls j, k being 10 cm, but not limited thereof. The vertical channels 15 can take any form in cross section, for example circular, oval, squared, pentagonal, hexagonal etc., the cylindrical channels with circular cross section being preferred. Cylindrical vertical channels 15 have a diameter of 15-30 cm, preferably 20 cm. The distance between the axes of the vertical channels 15 is the same with the distance between the axes of the vertical channels 8, being preferably 60 cm.

Figure 7:
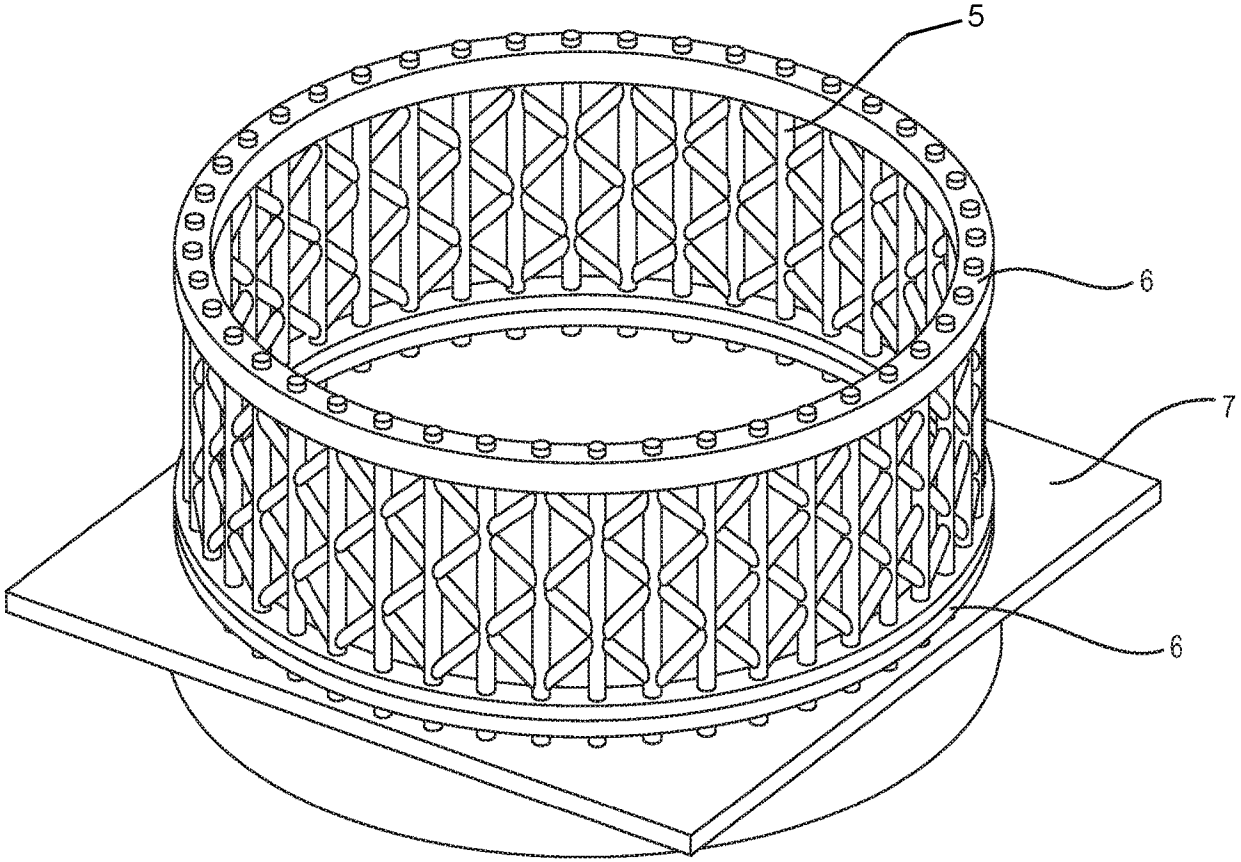
FIG. 7. Supporting structure.

The supporting structure is obtained by casting a hardening material in the network comprising annular horizontal channels formed by a plurality of compartments 18, as well as main joints, secondary joints and tertiary joints connected by vertical channels 8, 15 and oblique channels 9, the network being achieved by assembling a plurality of modular elements 1 and 2. The hardening material constituting the supporting structure is selected from concrete, reinforced concrete, polyester resins, epoxy resins, polyurethane resins. The supporting structure from FIG. 7 is found at the interior of an insulating structure obtained by assembling the modular elements 1 and 2 and comprises vertical and oblique pillars 5 obtained by filling the vertical channels 8, 15 and oblique channels 9 with hardening material and horizontal rings 6 obtained by filling the annular horizontal channels formed by the compartments 18 with hardening material. The rings 6 can endure pressures up to 1 bar (100 kPa).

The process for building a storage basin has the following steps:

- A plurality of U profiles 13 is assembled forming a first complete annular row, the U profiles 13 being reinforced with striated steel for reinforced concrete. Insulating plates are laid at the interior of the area delimited by assembling the U profiles 13, in order to obtain an insulation 3 of the storage basin bottom. Then the hardening material is cast so that the compartments 18 are filled and the insulation 3 of the storage basin bottom is covered, forming a foundation 7. After that, the lids 14 are placed on the top of U profiles 13;
- The modular elements 1 are assembled on two-four rows on the top of the first row of modular elements 2 and another row of U profiles 13 is placed on top of the modular elements 1, reinforcements are placed, and the hardening material is again cast in the network formed at this step by assembling the modular elements 1 and the U profiles 13. The lids 14 are placed on top of the U profiles 13.
- Previous step is repeated with all its phases until the desired height of the storage basin is achieved.
- A metallic structure is assembled at the upper part of the storage basin and plates of polyurethane foam are laid over the metallic structure, forming a insulating lid 4 of the storage basin.

The modular elements and the process according to the invention can be used for the construction of piscines, swimming pools etc.

MODES FOR CARRYING OUT THE INVENTION

Embodiment 1

A circular basin with a volume of 200 $m^3$ is built for the storage of hot water needed for heating a living space during the cold season. Twenty two modular elements of polyurethane foam are used for each row. The first annular row (ring) of twenty two U profiles 13 is placed. A reinforcement comprising four striated steel for reinforced concrete bars with a diameter of 20 mm, fastened with clamps with a diameter of 8 mm is assembled in compartments 18, and vertical reinforcements of four steel for reinforced concrete bars with a diameter of 14 mm, fastened with circular clamps with a diameter of 6 mm, are also assembled starting from each channel 15. Polyurethane plates with 24 cm thickness are laid, forming the insulation 3 of the bottom of the basin. Increased resistance concrete (C20/25) is cast in the compartments 18 and over the basin bottom insulation 3, in a layer of 10 cm thickness, forming the concrete foundation 7. The lids 14 are placed on top of U profiles 13.

Forty four modular elements 1 are placed on two annular rows on the top of the first row of elements 2. On top of them, another annular row of twenty two U profiles 13 is placed. A reinforcement made of four striated steel for reinforced concrete bars with a diameter of 20 mm, fastened with clamps with a diameter of 8 mm is assembled in compartments 18, and vertical reinforcements of four striated steel for reinforced concrete bars with a diameter of 14 mm, fastened with circular clamps with a diameter of 6 mm are also assembled. Increased resistance concrete (C20/25) is cast in the compartments 18 and in the vertical channels 8, 15 and oblique channels 9. Twenty two lids 14 are placed on top of U profiles 13.

Sixty six modular elements 1 are placed on three annular rows on the top of the second annular row of elements 2. On top of them, another annular row of twenty two U profiles 13 is placed, reinforcements are assembled and concrete is cast, as in the precedent step. The lids 14 are placed. The storage basin is covered on the inside with a hydro-insulating membrane made of rubber or polyurea. A metallic structure is assembled at the upper part of the basin, and plates of polyurethane foam 24 cm thick are laid over the metallic structure, forming a insulating lid 4 of the storage basin.

Embodiment 2

Storage Basin "Tank in Tank"

Two concentric basins for storage of hot water are built. The exterior basin has twenty two modular elements on each annular row and the interior one has fifteen modular elements on each annular row. The water in the interior tank is warmer than the water in the exterior tank. The heat of the water from the interior tank is not wasted through the vertical wall of said tank, but it changes into absorbed heat for the water in the exterior tank. The heat of the water with higher temperature (80-90° C.) from the interior tank is used to obtain hot house water and the heat of the water with a lower temperature (70-80° C.) from the exterior tank is used for heating a living space.

The construction of the "tank in tank" basin is similar to embodiment 1. The first concentric annular rows are placed, using thirty seven U profiles 13, the bottom of the basin is insulated with polyurethane plates 24 cm thick, reinforcements of steel for reinforced concrete with a diameter of 20 mm, fastened with clamps with a diameter of 8 mm are assembled in compartments 18, and vertical reinforcements of steel for reinforced concrete bars with a diameter of 14 mm, fastened with clamps with a diameter of 6 mm are also assembled. Increased resistance concrete (C20/25) is cast in the compartments 18 and on the basin bottom. The lids 14 are placed.

Then one hundred forty eight modular elements 1 are placed in four annular row on top of each annular row already achieved, and after that, thirty seven U profiles 13 are placed in two concentric annular rows over the modular elements 1.

Reinforcements are assembled in the same way and concrete is cast in the compartments 18 and in the vertical channels 8, 15 and oblique channels 9. The lids 14 are placed. The storage basin is covered on the inside with a hydro-insulating membrane made of rubber or polyurea. A metallic structure is assembled at the upper part of the basin, and plates of polyurethane foams 24 cm thick are laid over the metallic structure, forming a insulating lid 4 of the storage basin.

The invention claimed is:

1. A storage basin comprising a plurality of:

a first modular element for a wall having a body with a superior face, an inferior face, an interior face, and an exterior face representing coaxial cylinder sectors and lateral faces extending vertically between the superior face and the inferior face, the first modular element comprising in an interior at least two oblique channels and at least one vertical channel being provided between the oblique channels, the vertical channel uniting the superior face and the inferior face of the body, said channels communicating between them in order to form at least one main half joint, the oblique channels opening to the superior face and/or the inferior face, extending between the main half joints, or from the main half joint to median zones of the lateral faces of the first modular elements for the wall, forming secondary half joints, the vertical channel opening at least to the inferior face to form a tertiary half joint, the first modular element being provided with joint elements with at least another modular element;

a second modular element for strengthening having a U profile, with a horizontal bottom face provided with at least one vertical channel, an interior wall, an exterior wall, the interior wall and the exterior wall representing coaxial cylinder sectors, and a lid having a horizontal superior face provided with at least one vertical channel and joint elements with the U profile, the second modular element for strengthening being provided with joint elements with at least another modular element, wherein the first modular element for the wall and the second modular element for strengthening form a network, the network further including rings, main joints, secondary joints and tertiary joints connected through the vertical channels and the oblique channels.

2. The storage basin according to claim 1 wherein the superior face of the first modular element for the wall is parallel to the inferior face, the interior face, and the exterior face of the first modular element for the wall, representing coaxial cylinder sectors, the lateral faces of the first modular element belonging to planes that intersect in the cylinders axis, the first modular element having in the interior two vertical channels, three oblique channels, two main half joints, two secondary half joints, two tertiary half joints, and twelve joint elements.

3. The storage basin according to claim 1 wherein the oblique channels and the vertical channels of the first modular element for the wall are cylindrical, having a circular cross section.

4. The storage basin according to claim 1 wherein the angle between the oblique channels and the vertical channels of the first modular element for the wall is 45°.

5. The storage basin according to claim 1 wherein the interior wall and the exterior wall of the second modular element for strengthening represent coaxial cylinder sectors, the second modular element for strengthening being provided with four vertical channels and twelve joint elements.

6. The storage basin according to claim 1 wherein the first modular element for the wall and the second modular element for strengthening are made of a material selected from the group consisting of polyurethane, polyimide, polyethylene, polypropylene, polyvinylchloride, polyvinylidene chloride, amino resin, phenolic resin, silicone, expanded polystyrene and sodium silicate.

7. The storage basin according to claim 1 wherein the network further comprises a unitary supporting structure of a cast hardening material selected from the group consisting of concrete, polyester resin, epoxy resin, and polyurethane resin.

8. The storage basin according to claim 7 wherein the unitary supporting structure is located within an insulating structure.

9. The storage basin according to claim 8 wherein the insulating structure comprises a plurality of assembled modular elements.

10. A process for constructing a storage basin according to claim 1, which comprises the following steps:

(a) assembling a first row of U profiles;

(b) thermally insulating the storage basin at the bottom;

(c) casting a hardening material to fill in an obtained ring and to cover the bottom of the storage basin;

(d) placing lids on top of the U profiles;

(e) assembling modular elements for the wall on two-for rows on top of the first row and placing another row of U profiles on top of the first modular element for the wall, following casting of the hardening material according to step c) and the placement of the lids according to step (d);

(f) repeating step e) until a desired height of the storage basin is achieved;

(g) assembling a metallic structure at the superior part of the storage basin and laying plates of polyurethane foam on top of the metallic structure to form an insulating lid on the storage basin.

* * * * *